United States Patent [19]

Bethurum

[11] 4,269,462

[45] May 26, 1981

[54] ZERO INSERTION FORCE CONNECTOR

[75] Inventor: Gary C. Bethurum, El Segundo, Calif.

[73] Assignee: Thomas & Betts Corporation, Raritan, N.J.

[21] Appl. No.: 77,645

[22] Filed: Sep. 21, 1979

[51] Int. Cl.[3] ..... H01R 13/62

[52] U.S. Cl. ..... 339/74 R; 339/75 M; 339/200 P

[58] Field of Search ..... 339/61 R, 61 M, 74 R, 339/75 R, 75 M, 75 MP, 91 R, 200 P, 255 P, 66 M

[56] References Cited

U.S. PATENT DOCUMENTS

| | | | |
|---|---|---|---|
| 3,130,351 | 4/1964 | Giel | 339/74 R |
| 3,487,352 | 12/1969 | Putyato et al. | 339/66 M |
| 3,594,699 | 7/1971 | Jayne et al. | 339/75 MP |
| 3,639,888 | 2/1972 | Pittman et al. | 339/75 MP |
| 3,803,533 | 4/1974 | Taplin | 339/91 R |
| 3,820,054 | 6/1974 | Clewes et al. | 339/17 CF |
| 3,825,878 | 7/1974 | Finger et al. | 339/176 MF |
| 3,865,457 | 2/1975 | Carter | 339/74 R |
| 3,977,748 | 8/1976 | Gruhn et al. | 339/75 M |
| 3,994,554 | 11/1976 | Navarro | 339/99 R |
| 4,060,295 | 11/1977 | Tomkiewicz | 339/17 LC |
| 4,067,633 | 1/1978 | Groft et al. | 339/74 R |
| 4,077,688 | 3/1978 | Cobaugh et al. | 339/74 R |
| 4,084,874 | 4/1978 | Georgopolos | 339/75 MP |
| 4,148,537 | 4/1979 | Sochor | 339/74 R |
| 4,190,311 | 2/1980 | Basta | 339/200 P |

FOREIGN PATENT DOCUMENTS

| | | | |
|---|---|---|---|
| 587539 | 1/1978 | U.S.S.R. | 339/75 MP |

*Primary Examiner*—Neil Abrams

*Attorney, Agent, or Firm*—Robert M. Rodrick; Jesse Woldman

[57] ABSTRACT

A zero insertion force connector wherein a central member supports a plurality of electrical contacts at a first end with the free ends thereof mounted in two side members pivotally coupled to such central member. The manipulation of first distal ends of such side members controls the position of the second distal ends and in turn the electrical contacts. In a first position, the second distal ends are separated permitting external electrical contact to be non-engagingly moved between the electrical contacts of the connector. In the second position, the second distal ends bring the electrical contacts into mechanical and electrical contact with the inserted external electrical contacts. A latching member permits the second position to be maintained while various bias means and stops assist. The electrical contacts are of the insulation piercing type and engage the conductors of a flat cable when a cover forces the cable into the insulation piercing portion. The continuity of the joint can be probed through apertures in the side members.

12 Claims, 12 Drawing Figures

ZERO INSERTION FORCE CONNECTOR

BACKGROUND OF THE INVENTION

1. Field of the Invention

The invention is directed to connectors for joining conductors to printed circuits directly or through headers soldered to the printed circuit and more particularly where the connections are to be made with minimal contact between the mating parts during insertion or withdrawal.

2. Description of the Prior Art

Zero insertion force connectors are known in the prior art and almost all require some type of camming bar or mechanism to move the contacts from a relaxed position to an engagement position. Return of the contacts to the relaxed state usually employs the natural resiliency of the contact effective once the camming bar has been withdrawn. No positive mechanism is employed to insure the contacts are separated and any contact that does not return due to such factors as fatigue, distortion, cold flow, etc., may be destroyed when the printed circuit board is removed. Engagement is also not positive since the camming bar must operate through some device on the contact itself to move the contact to the engagement position. Misalignment, manufacturing tolerances, etc., may not provide the desired engagement between the contact and camming bar to assure its proper operation.

SUMMARY OF THE INVENTION

The present invention overcomes the problems noted above with respect to prior art zero insertion force connectors by providing a connector whose contacts are positively operated to the engagement and disengagement positions upon the operation of the connector side walls to which the contacts are directly connected. Two side members, to which the free ends of a plurality of electrical contacts are mounted, are pivotally coupled to a central member supporting the electrical contacts so that manipulation of first distal ends of such side members controls the position of the second distal ends and in turn the electrical contacts. In a first position, the second distal ends are separated, permitting external electrical contacts to be non-engagingly moved between the electrical contacts of the connector. In the second position, the second distal ends bring the electrical contacts into mechanical and electrical contact with the inserted external electrical contacts. A latching member permits the second position to be maintained while various bias means and stops assist. The side members provide a cable passage therethrough into which the ends of the contacts also extend. The contacts having insulation piercing end portions make contact with the individual conductors once a cover has been operated to force the cable into contact with the contacts. The side members also provide windows through which probes can be inserted to test the electrical circuits involved. It is therefore an object of this invention to provide an improved zero insertion force connector.

It is another object of this invention to provide a positively operated zero insertion force connector.

It is still another object of this invention to provide a zero insertion force connector with contacts of the insulation piercing type.

It is another object of this invention to provide a zero insertion force connector, the contacts of which can be electrically probed from outside of the connector.

Other objects and features of the invention will be pointed out in the following description and claims and illustrated in the accompanying drawings, which disclose, by way of example, the principles of the invention and the best modes which have been contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
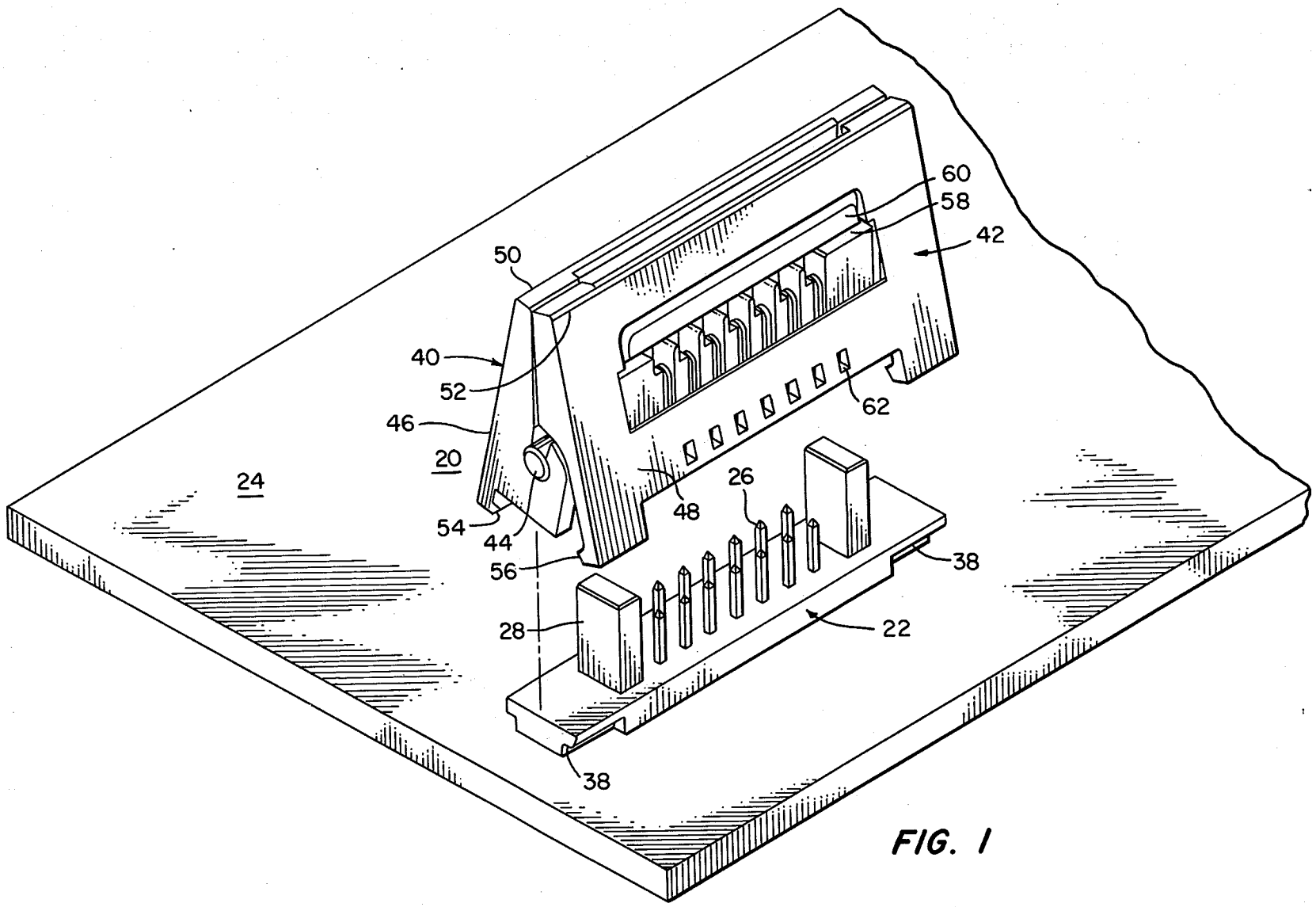
FIG. 1 is an exploded perspective view of a zero insertion force connector constructed in accordance with the concepts of the invention.
Figure 2:
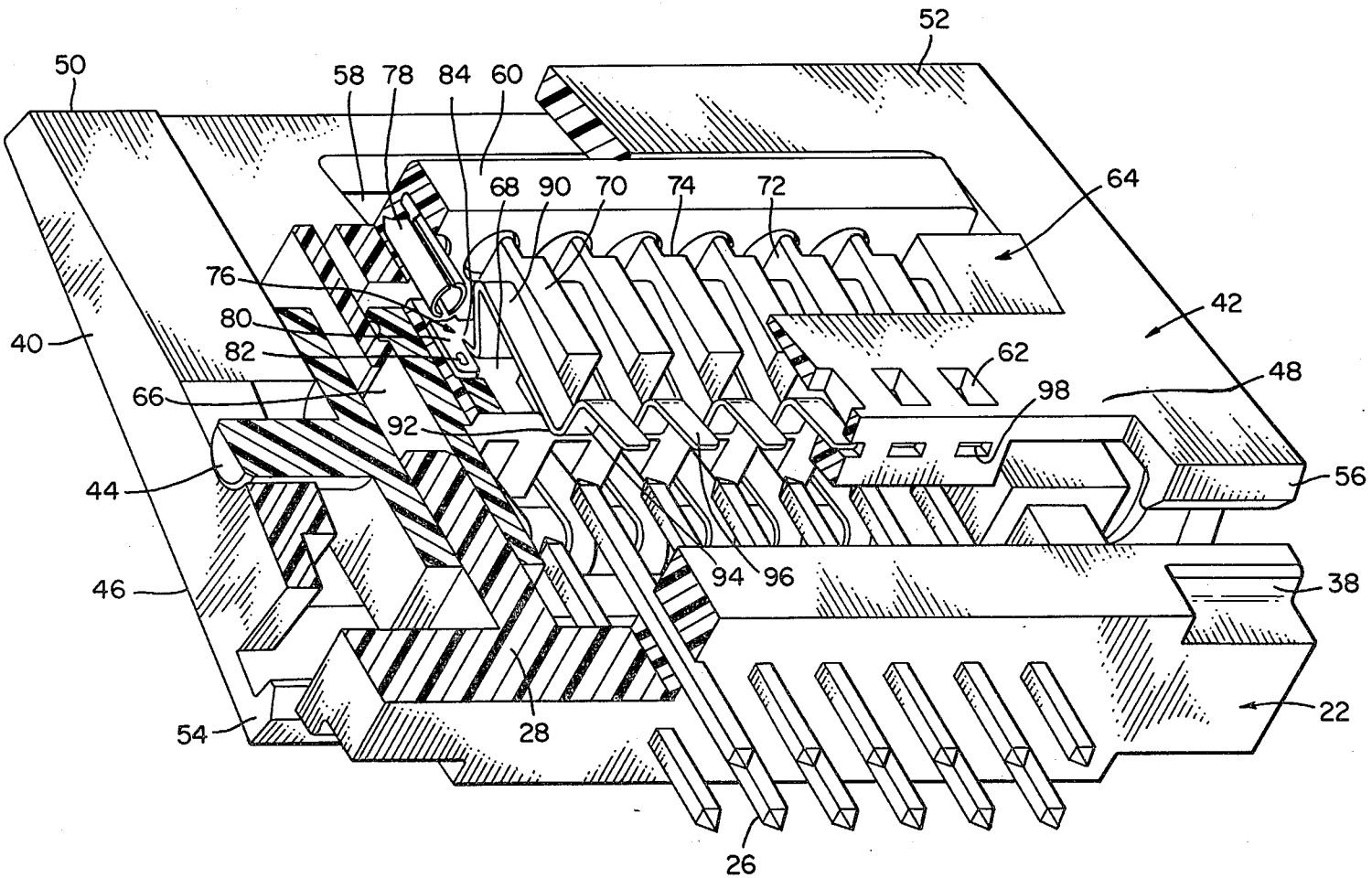
FIG. 2 is a perspective view, partly cut away and partly in section, of the connector of FIG. 1 in its assembled condition.
Figure 3:
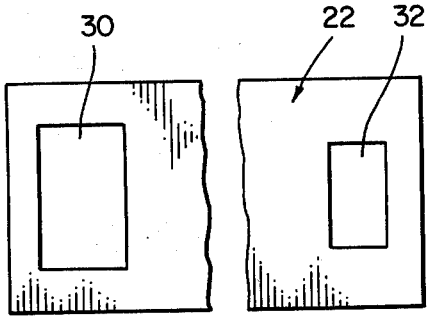
FIG. 3 is a top plan view of a further embodiment of the base of the connector of FIG. 1.
Figure 4:
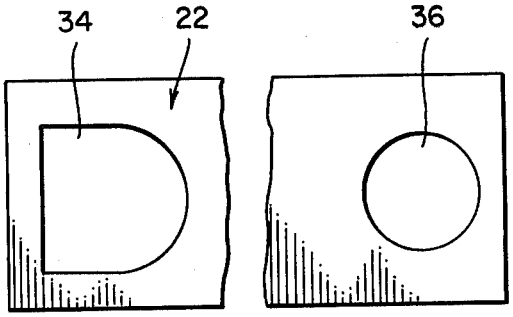
FIG. 4 is a top plan view of a further embodiment of the base of the connector of FIG. 1.
Figure 6:
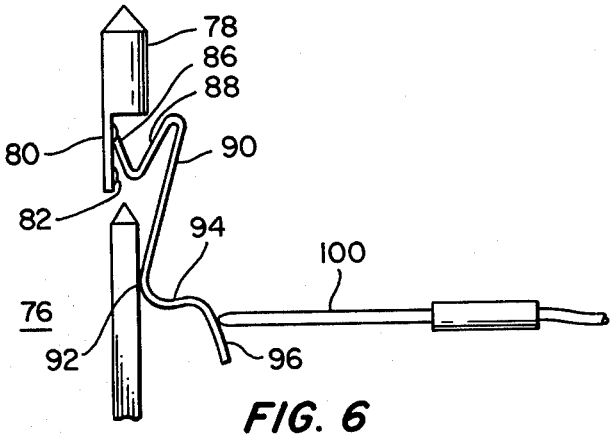
FIG. 6 is a side elevation of the contact of the connector of FIG. 1.
Figure 5:
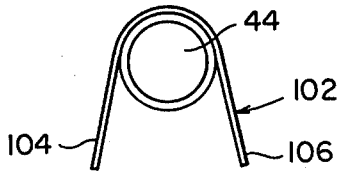
FIG. 5 is a side elevation of a detail of the connector of FIG. 1.

Turning now to FIGS. 1 to 11, there is shown a zero insertion force connector 20 constructed in accordance with the concepts of the invention. Connector 20 is arranged to mate with and latch to a header 22 coupled to a printed circuit board 24 or the like. The header pins 26 extend through plated through holes (not shown) in the printed circuit board 24 and are soldered or otherwise coupled to the underside of the board 24. Header 22 also provides positioning blocks 28 engageable with connector 20 to position and align the connector 20 with the header 22. The blocks 28 may be of the same size and shape as shown in FIG. 1 or may be of different sizes as the blocks 30, 32, respectively, in FIG. 3 or of different shapes as the blocks 34, 36, respectively, in FIG. 4 to also provide polarization of the connector 20 with respect to the header 22. Any other combination of size, shape or position of the blocks may be used, as desired, to provide necessary polarization. Header 22 may have undercut portions 38 to engage with latch arms of the connector 20, to latch the connector 20 to the header 22, as will be set forth below.

Connector 20 has a first side member 40 and a second side member 42 pivotally coupled as by pin 44. The clothespin-like action of the first and second side members 40, 42, respectively, results in the separation of first ends 46, 48, respectively, when the second ends 50, 52, respectively, are advanced towards one another. Conversely, when the second ends 50, 52, respectively, are separated, the first ends 46, 48, respectively, move towards one another. The first ends 46, 48, respectively, each terminate in inturned latch arms 54, 56, respectively, which engage with the undercut portions 38 of header 22 to latch connector 20 to header 22. The latch will be applied when the second ends 50, 52, respectively, are separated and will be released when the ends 50, 52, respectively, are moved towards one another. A cable aperture 58 extends through side members 40, 42 adjacent the second ends 50, 52 respectively. Placed for movement within cable aperture 58 is a cover 60 employed to force a multiconductor flat cable 61 into engagement with the insulation piercing portions of electrical contacts in a manner to be set forth below. A series of probe apertures 62 extend along the first ends 46, 48, respectively, of side members 40, 42. Each aperture 62 is juxtaposed one of the electrical contacts of the connector 20 to permit same to be electrically tested by a probe inserted through apertures 62.

Central member 64 is the contact carrier and provides the pivot pin 44 about which the first side member 40 and second side member 42 pivot. A cavity 66 receives the positioning blocks 28 of the header 22 to locate connector 20 with respect to the header 22. Positioned along a central skeleton 68 are a series of stub walls 70 defining therebetween contact recesses 72. Each stub wall 70 is notched as at 74 near its end adjacent ends 50, 52 of side members 40, 42, respectively. Slots (not shown) extend in the stub walls 70 below notches 74, as will be described below.

Contacts 76 have an insulation piercing portion 78 of the type more fully described in U.S. Pat. No. 3,964,816 issued June 29, 1976 entitled "Electrical Contact" to Ronald S. Narozny and assigned to the assignee of the instant invention. Extending from the portion 78 is a tab 80 with two dimples 82 thereon. The tab 80 will fit within the slots in the stub walls 70 to hold the contacts 76 to the central member 64. A transverse tab 84 extends from the tab 80. Contact arm 90 is coupled to tab 84 through arms 86 and 88 which hold the contact arm 90 away from the plane of tab 80 and 84 but permit same to be directed towards such plane to make a good electrical contact with a pin 26 inserted within contact recess 72 adjacent contact arm 90 contact area 92. Extending from contact area 92, the contact arm 90 has a portion 94 perpendicular to the tab 80 and finally a tail portion 96 anchored to either of the side members 40, 42 by entry into apertures 98 therein. By anchoring the tail portions 96 of the contact arm 90 in the side members 40, 42 the position of the contact arm is controlled by the positions of the side members 40, 42. When the first ends 46, 48 of the side members 40, 42, respectively, are separated the contact portions 94 are pulled away from any pins 26 inserted in contact recesses 72 and the pins 26 may be freely inserted or removed from such recesses 72. However, when the first ends 46, 48 are latched in their closest position, the contact portions 94 are pushed into contact with any pins 26 inserted into contact recesses 72 and the pins 26 can only be inserted or removed from such recesses 72 with difficulty. A series of windows 62, one adjacent each tail portion 96, permits a probe 100 to be inserted therethrough to contact the tail portion 96 and thus test the contact and the circuits coupled thereto.

Figure 11:
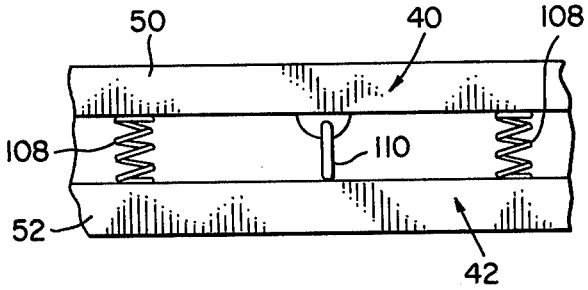
FIG. 11 is a fragmentary top plan view of alternate embodiments of the connector of FIG. 1.

To better control the positions of the side members 40, 42 a spring 102 (see FIG. 5) can be placed about the pivot pin 44 with its ends 104, 106 bearing upon the side members 40, 42, respectively, to insure that once the latch arms 54, 56 are removed from undercuts 38 the side members 40, 42, respectively, will open to prevent undesired contact between contact arms 90 and pins 26. Alternately, if it is desired to insure that the side members 40, 42 will not accidentally pivot to release the contact arms 90 from pins 26, compression springs 108 can be inserted between the second ends 50, 52 of the side members 40, 42, respectively, as shown in FIG. 11. Also, a stop 110 pivotally mounted to side member 40 could be employed. The stop 110 could be swung to the position shown in FIG. 11 when the second ends 50, 52 of side members 40, 42, respectively, were separated to maintain such separation.

Figure 7:
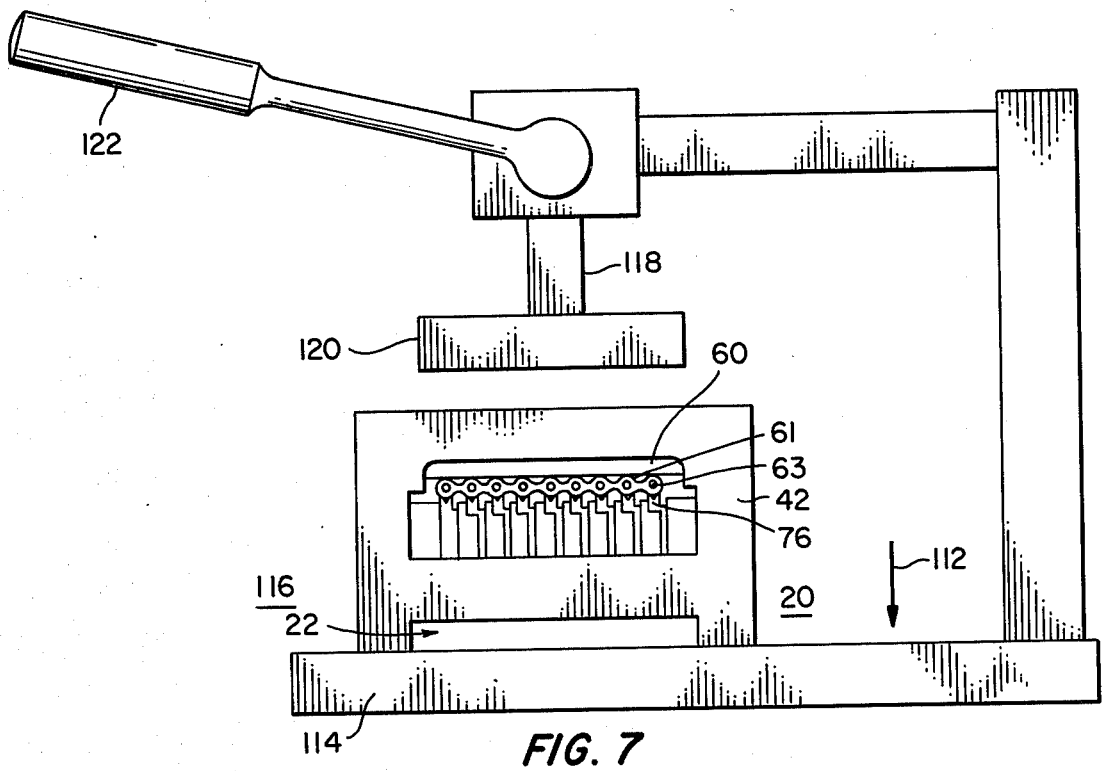
FIG. 7 is a side elevation of the connector of FIG. 1 with an installing tool.
Figure 8:
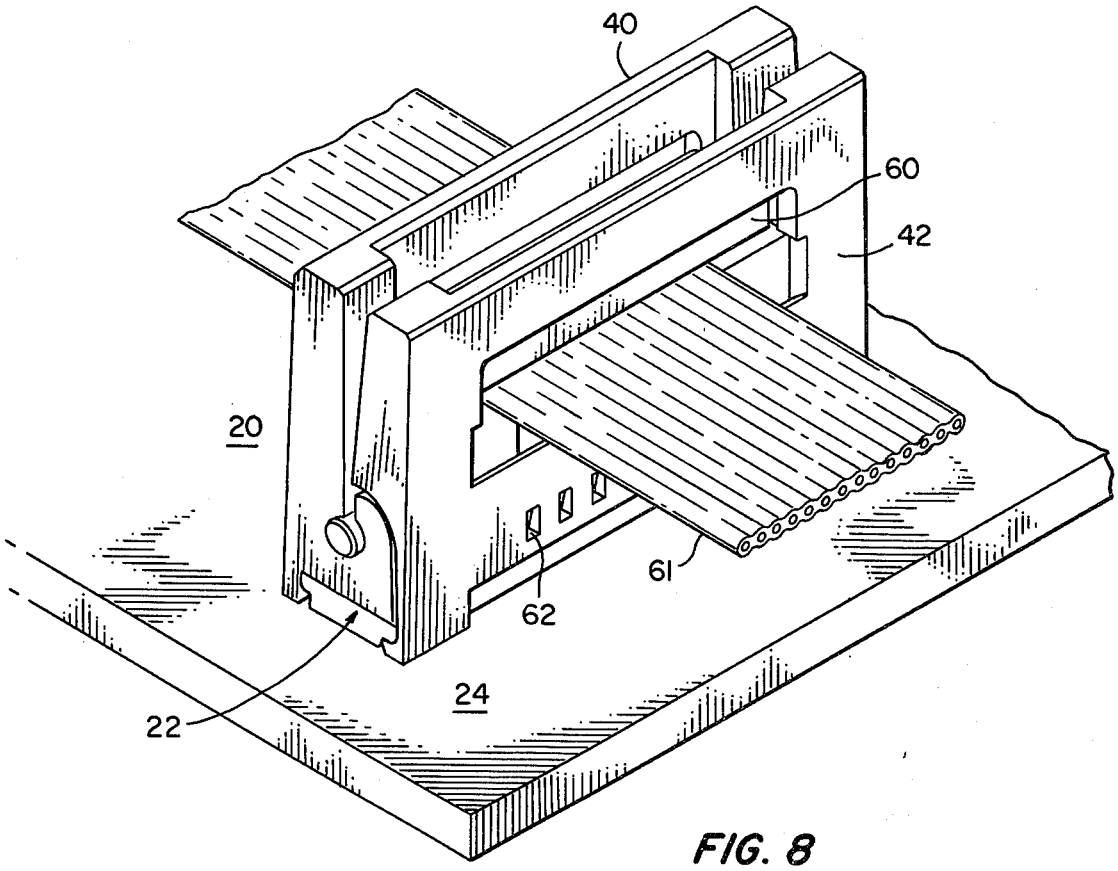
FIG. 8 is a perspective view of the connector of FIG. 1 assembled to a length of flat cable.

Once the connector 20 has been positioned upon the header 22 and the side members 40, 42 have been latched to the header 22, the joint between the header 22 and the connector 20 is completed. To complete the connection between the connector 20 and the multiconductor cable 61, the following procedure must be employed. The flat cable 61 is inserted between cover 60 and the insulation piercing portions 78 of contacts 76 and aligned so that one conductor 63 is aligned with each portion 78 and the cover 60 is forced downwardly in the direction of the arrow 112, as shown in FIG. 7. To push the cover 60 downwardly with the required force the connector 20 can be placed on the base 114 of a press 116 and the ram 118 with appropriate platen 120 attached can then be operated by lever 122 in known manner. The platen 120 is admitted between the second ends 50, 52 of the side members 40, 42, respectively.

Figure 9:
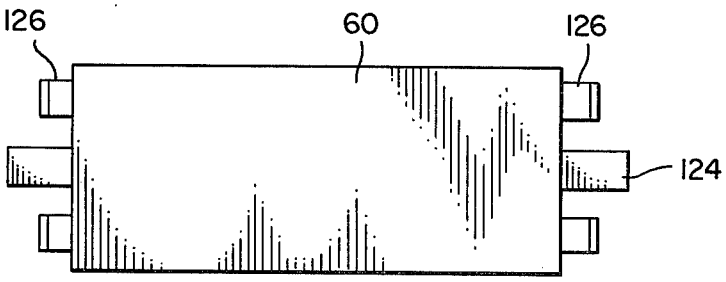
FIG. 9 is a top plan view of the cover of the connector of FIG. 1.
Figure 10:
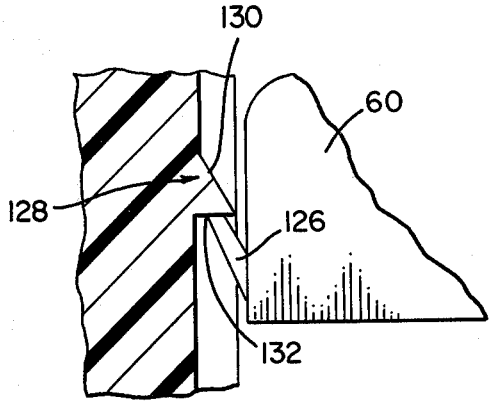
FIG. 10 is a fragmentary side elevation, partly in section, of the cover latch.

To retain the cover 60 within the cable aperture 58, tabs 124 can be placed on the ends of the cover 60, as is shown in FIG. 9, the tabs 124 will remain between the side members 40, 42 whether closed or separated. Latches 126 provide means to latch the cover 60 in the down position once the cable 61 has been made to engage the insulation piercing portions 78 of contacts 76. As is seen in FIG. 10, the latch 126 is made to engage inclined stop 128 upon side members 40, 42. As the cover 60 descends in the direction of the arrow 112 in FIG. 7, the latch 126 is deflected towards cover 60 by the inclined surface 130 of stop 128. Once the end of latch 126 ceases to contact the inclined surface 130 it will move outwardly away from cover 60 to engage the step surface 132 of stop 128 and prevent retrograde of the cover 60 under forces applied to the cable 61.

Figure 12:
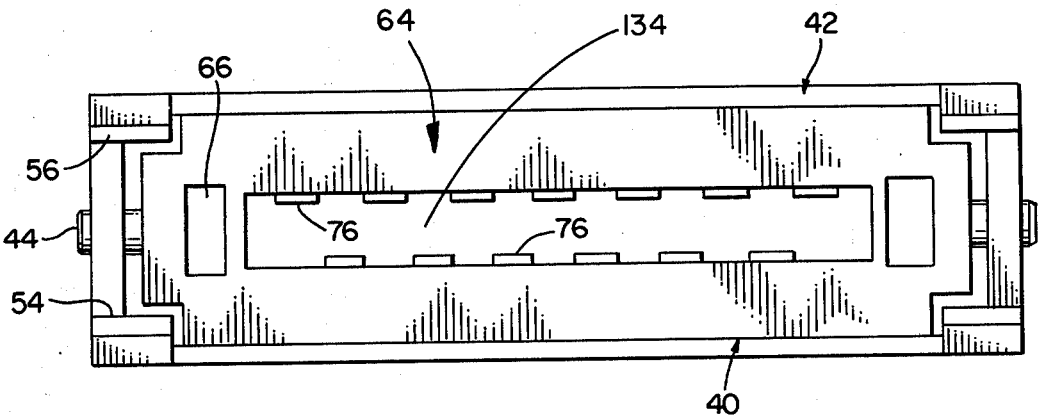
FIG. 12 is a bottom plan view of an alternate embodiment of a connector constructed in accordance with the concepts of the invention.

FIG. 12 shows an adaptation of the connector 20 of FIG. 1 to be used directly with printed circuit boards without the intervention of headers. The central member 64 has portions of the skeleton 68 and stub walls 70 removed to provide a slot 134 into which the board (not shown) can be inserted. The contacts 76 enter into slot 134 to make contact with the conductive lands on the board. Positioning blocks can be placed upon the board to enter the cavities 66. Similarly, undercut blocks to engage the latch arms 54,56 can also be provided upon the board. The remaining functions of the connector would be duplicative of the connector 20 of FIG. 1.

While there have been shown and described and pointed out the fundamental novel features of the invention as applied to the preferred embodiments, it will be understood that various omissions and substitutions and changes in the form and details of the devices illustrated and in their operation may be made by those skilled in the art, without departing from the spirit of the invention.

The embodiments of the invention in which an exclusive property or privilege is claimed are defined as follows:

1. A zero insertion force connector, comprising:

a center member supporting a plurality of deflectable electrical contacts and having at least one opening therein in communication with said contacts for receiving therein a plurality of conductive members;

a first side member coupled to end portions of a first plurality of said electrical contacts;

a second side member coupled to end portions of a second plurality of said electrical contacts;

at least one of said side members having therethrough an aperture for passage of a cable, said aperture communicating with an uncoupled end of each of said first and second pluralities of electrical contacts;

said side members each having corresponding first and second distal ends, said side members being pivotally coupled to said center member at a location between said first and second distal ends to allow movement of a first end toward and away from the corresponding other first end when a second end is moved respectively away from and toward the other corresponding second end, said first and second pluralities of electrical contacts being movable relative to said opening with the movement of said side members.

2. A connector according to claim 1 wherein said first distal ends of said first and second side members further comprise handle members for controlling the movement of the said second distal ends of said side members.

3. A connector according to claim 1, wherein said opening comprises a single aperture in communication with the first and second pluralities of electrical contacts.

4. A connector according to claim 1, including a plurality of openings, wherein each of said electrical contacts communicates individually with one of said plurality of openings.

5. A connector according to claim 1, wherein each contact of said pluralities of said first and second electrical contacts terminates at its uncoupled end in an insulation piercing portion extending into said apertures.

6. In combination:

a supporting member having a plurality of conductive elements thereon; and a connector housing having a center member supporting a plurality of deflectable electrical contacts, said center member having at least one opening therein in communication with said contacts, said conductive elements extending into said opening and contacting said contacts, a first side member coupled to end portions of a first plurality of said electrical contacts; and a second side member coupled to end portions of a second plurality of said electrical contacts, said first and second side members each having handle ends and latching ends, said side members being pivotally coupled to said center member at a location intermediate said handle ends and said latching ends, said latching ends engaging a portion of said supporting member and thereby holding said side members at a fixed position relative to each other, said electrical contacts at such position being urged by said side members into pressing contact with said conductive elements.

7. A combination according to claim 6, further including biasing means coupled between said handles ends for maintaining said latching ends in engagement with said portion of said supporting member.

8. A combination according to claim 6, further comprising stop means coupled between said first and second side members to prevent relative movement therebetween.

9. A combination according to claim 6, wherein each of said side members has therethrough an aperture for passage of a cable, said aperture communicating with an uncoupled end of each of said first and second pluralities of electrical contacts.

10. A combination according to claim 9, wherein each contact of said pluralities of said first and second electrical contacts terminates at its uncoupled end in an insulation piercing portion extending into said apertures.

11. A combination according to claim 10, further comprising cover means positioned in said cable apertures and movable to urge flat cable adjacent thereto into electrical and mechanical contact with the insulation piercing portions of said electrical contacts.

12. A combination according to claim 6, wherein said supporting member comprises a header and wherein said conductive elements comprise conductive pins extending through said header.

* * * * *